United States Patent [19]

Smith

[11] Patent Number: 4,950,014

[45] Date of Patent: Aug. 21, 1990

[54] FIREWOOD CARRIER

[76] Inventor: Gregory M. Smith, 12521 212th SE., Snohomish, Wash. 98290

[21] Appl. No.: 339,580

[22] Filed: Apr. 18, 1989

[51] Int. Cl.[5] ..... B65D 63/18; B65D 71/02

[52] U.S. Cl. ..... 294/152; 294/74; 294/156

[58] Field of Search ..... 294/31.2, 67.4, 74, 294/75, 77, 81.55, 119.2, 138, 140, 149–157, 165, 167–169, 137; 5/82 R, 89

[56] References Cited

U.S. PATENT DOCUMENTS

| | | | |
|---|---|---|---|
| 423,380 | 3/1890 | Fry | 294/152 |
| 722,456 | 3/1903 | Reeves | 5/82 R |
| 879,335 | 2/1908 | Southmayd | 5/82 R |
| 1,118,519 | 11/1914 | Weaver | 294/152 |
| 1,173,459 | 2/1916 | Palmer | 5/89 |
| 1,971,322 | 8/1934 | Miller | 294/152 |
| 2,397,433 | 3/1946 | Reeves | 294/156 |
| 2,427,246 | 9/1947 | Whittington | 294/152 X |
| 2,778,555 | 1/1957 | Poryle | 294/137 X |
| 2,813,745 | 11/1957 | Frieder et al. | 294/77 |
| 2,973,218 | 2/1961 | Schaum | 294/152 X |
| 3,211,489 | 10/1965 | Gill | 294/152 X |
| 3,481,519 | 12/1969 | Snetselaar | 294/152 |
| 4,626,015 | 12/1986 | Kruyt | 294/152 |

FOREIGN PATENT DOCUMENTS

| | | | |
|---|---|---|---|
| 1330222 | 5/1963 | France | 294/77 |
| 212624 | 6/1965 | Sweden | 294/77 |

*Primary Examiner*—Johnny D. Cherry

[57] ABSTRACT

A rectangular central flexible web or sling has its opposite ends rigidified by cross braces. Several handles extend outward at each end of the web. Each handle includes a double-thickness overfolded tab or web with spaced grommets for the ends of a cordlike handle loop. Loops at opposite ends of the sling are aligned.

5 Claims, 1 Drawing Sheet

FIREWOOD CARRIER

BACKGROUND OF THE INVENTION

1. Field of the Invention

The present invention relates to a new and improved carrier of the type having an elongated flexible web or sling and handles at the opposite ends thereof.

2. Prior Art

The prior art has heretofore set forth a variety of carriers for the transport of elongate articles, such as firewood, that effect conformity of a web or sling to the firewood. Heretofore, however, it appears that the prior art has failed to set forth a firewood carrier that enables ease of portage utilizing a single hand by a user or utilizing alternatively both hands such as for the transport of excessively heavy or bulky elongate articles. An example of a prior art firewood carrier may be found in Schaum U.S. Pat. No. 2,973,218, issued Feb. 28, 1961, wherein a central rigid platform is provided. Straps extend outwardly from the sides of the platform to a single handle. It can be difficult to balance a load with the single handles at each end.

Reeves U.S. Pat. No. 2,397,433, issued Mar. 26, 1946, sets forth an article carrier wherein, as in other prior art devices, a single handle is positioned centrally of a flexible central web or sling.

Similarly, Miller U.S. Pat. No. 1,971,322, issued Aug. 21, 1934, discloses a carrier which utilizes a pair of opposed cord handles positioned medially of a central flexible web for transport of firewood and the like within the web.

Snetselaar U.S. Pat. No. 3,481,519, issued Dec. 2, 1969, sets forth a transport carrier utilizing a single handle pair positioned medially of a central web for transport of articles. The Snetselaar web is formed of a woven wirelike screen for securement of articles therewithin.

Kruyt U.S. Pat. No. 4,626,015, issued Dec. 2, 1986, sets forth a rigid platform with a pair of opposed single handles pivotally mounted to either end of the platform for securement of wood logs and the like positioned upon the platform.

As such, it may be appreciated that there is a continuing need for a new and improved firewood carrier wherein the same addresses both the problems of ease of use and selective grasping of the carrier, and in this respect, the present invention substantially fulfills this need.

SUMMARY OF THE INVENTION

In view of the foregoing disadvantages inherent in the known types of firewood carriers now present in the prior art, the present invention provides a firewood carrier wherein the same enables selective manual securement of the firewood carrier in transport of elongate articles therewithin. As such, the general purpose of the present invention, which will be described subsequently in greater detail, is to provide a new and improved firewood carrier which has all the advantages of the prior art firewood carriers and none of the disadvantages.

To attain this, the present invention comprises a firewood carrier utilizing an elongate flexible central web or sling formed of a waterproof impermeable interwoven fabric wherein a first series of three equally spaced overfolded handle webs are positioned and formed at one end of the web with a second series of three overfolded handle webs formed at the other end of the central web. Each handle web includes a pair of aligned apertures formed through the double thickness inner and outer web portions defining each handle web, and each of the inner and outer webs are secured together by grommets to secure the inner and outer webs of each handle web together. A flexible cordlike handle loop has its opposite ends directed through each pair of grommets within each handle web to enable transport of the carrier by use of a single manual grasping of the central handle loops or utilizing both hands in grasping outwardly positioned handle loops. The first and second trio of handle webs on each end of the carrier are equally spaced such that the handle loops of opposite sides of the central web are in alignment when the central web is formed about elongate articles to be transported. A rigid elongate cylindrical brace is formed at the base of each trio of handle webs to effect geometric integrity to the firewood carrier of the instant invention.

DETAILED DESCRIPTION OF THE PREFERRED EMBODIMENTS

Figure 1:
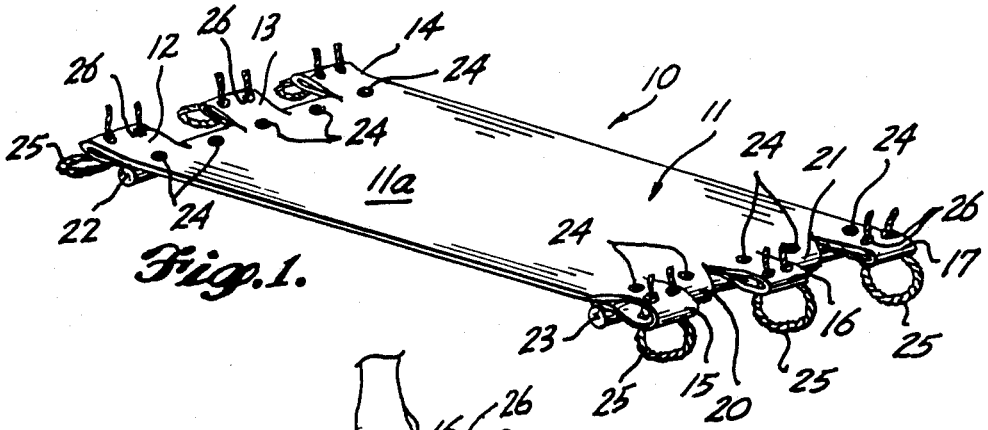
FIG. 1 is an isometric illustration of the firewood carrier of the instant invention.
Figure 2:
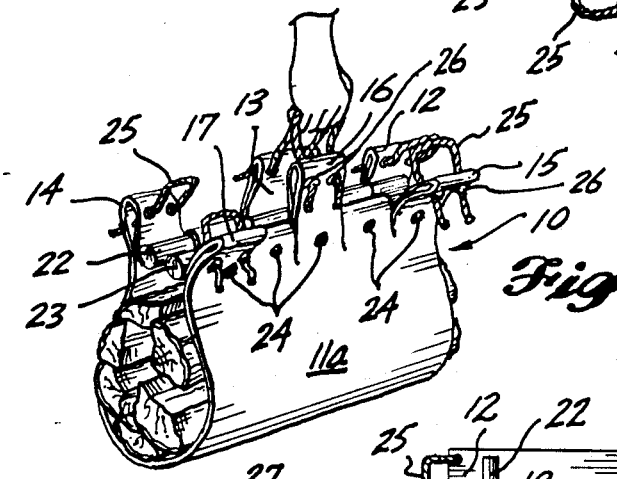
FIG. 2 is a isometric illustration of the firewood carrier of FIG. 1 showing the device secured about articles to be transported.
Figure 4:
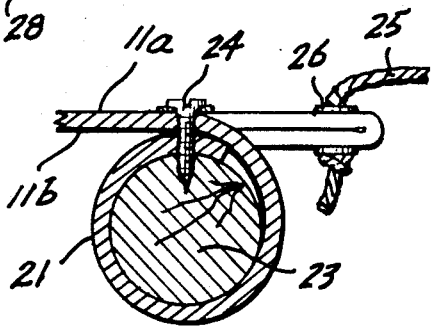
FIG. 4 is a section taken along line 4—4 of FIG. 3.

With reference to the drawings, the firewood carrier 10 of the present invention essentially comprises an elongated rectangular flexible central web or sling 11 having an outer face 11*a* and an inner face 11*b*. The web 11 is preferably formed of a waterproof interwoven polymeric material including up to ten percent acrylic nylon. A first end of the web portion 11 includes a plurality of handle webs. Preferably, three handle webs are formed at such first end, namely, a first, second and third handle web 12, 13 and 14, respectively. Each handle web includes an overfolded portion to define a double thickness layer of an inner and outer webbing, as illustrated in FIGS. 1, 2 and 4, for example. The opposite or second end of the web 11 includes a plurality of identical handle webs, preferably a fourth, fifth and sixth handle web 15, 16, and 17, respectively. The first and third handle webs 12 and 14 are positioned at the opposite sides of the web 11, and the second handle web 13 is positioned medially of the central web 11. The fourth and sixth handle webs 15 and 17 are positioned at the opposite sides of the web 11, and the fifth handle web 16 positioned medially thereof. In a juxtaposed position, the first and fourth handle webs 12 and are in alignment, the second and fifth handle webs 13 and 16 are in alignment and the third and sixth handle webs 14 and 17 are in alignment, as seen in FIG. 2.

Figure 3:
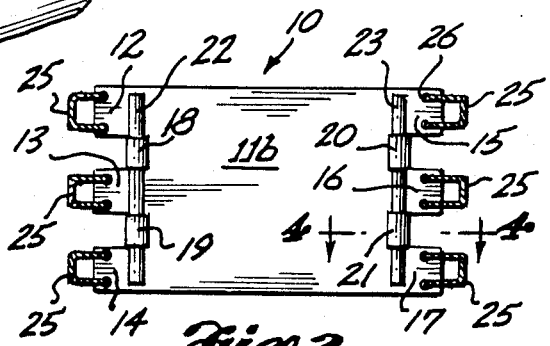
FIG. 3 is a top plan of the interior surface of the firewood carrier of FIG. 1.

An elongate first cylindrical brace 22 is arranged coextensively of the first end of the central web 11, and a parallel second cylindrical brace 23 is positioned at the second end. A first brace support web 18 is in a surrounding overlying relationship to the first cylindrical brace 22 and positioned between the first and second handle webs 12 and 13. A second brace support web 19 is positioned between the second and third handle webs 13 and 14 and circumferentially surrounds the first cylindrical brace 22 spaced from the first brace support web 18. In a like manner, third and fourth brace support webs 20 and 21 are positioned, respectively, between the pairs of respective fourth and fifth handle webs 15 and 16 and the fifth and sixth handle webs 16 and 17, as seen in FIGS. 1 and 3, for example. A threaded fastener 24 extends through each of the handle webs 12 through 17 at the base of the handle webs and radially into the respective cylindrical brace 22 or 23. Similarly, a threaded fastener 24 secures each of the brace support webs 18 through 21 radially into the respective cylindrical brace.

Figure 5:
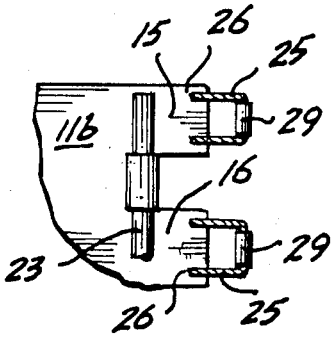
FIG. 5 is a fragmentary top plan of a modified form of firewood carrier in accordance with the present invention.

Each of the handle webs has a pair of through apertures wherein each of the apertures includes a brass or polymeric grommet 26 to secure the inner and outer sheets of each handle web 12 through 18 together. A through-extending flexible cord handle loop 25 is provided for each of the six handle webs with the opposite ends of the loops extending through the respective through apertures. Alternatively, a cylindrical tube handle 29, as illustrated in FIG. 5, may be provided with each associated cord handle 25 extending therethrough. The tube handle 29 would be of a length less than that of the spacing of the respective grommets 26 of an associated handle web, as illustrated in FIG. 5. The tube handles are utilized for enhanced comfort in the portage of the firewood carrier 10. It should be appreciated therefore that the firewood carrier 10 may be transported by manipulation of the central handles associated with the second and fifth handle webs 13 and 16, or alternatively if dual hand grasps are desired in accommodation of a somewhat heavier workload, the exterior pairs of handles 25 associated with the first and fourth handle webs and the third and sixth handle webs may be utilized.

Figure 6:
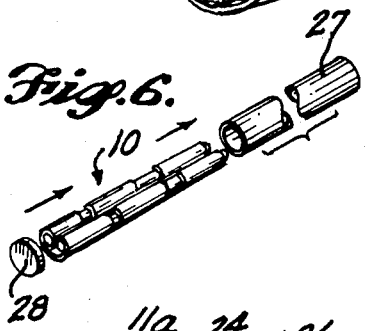
FIG. 6 is a fragmentary isometric of the firewood carrier of FIG. 1 secured within a container.

FIG. 6 illustrates that the firewood carrier 10 subsequent to cleaning, may be rolled and inserted within an associated tubular container 27 and an overlying lid 28 to enable storage of the device until subsequent use is desired.

As to the manner of usage and operation of the instant invention, the same should be apparent from the above disclosure and accordingly no further discussion relative to the manner of usage and operation of the instant invention shall be provided.

I claim:

1. A firewood carrier comprising an elongate planar central web including a first end spaced from and parallel to a second end, a first, second and third handle means extending outwardly of said first end, said first, second and third handle means being equally spaced along said first end, a fourth, fifth and sixth handle means extending outwardly from said second end, said fourth, fifth and sixth handle means being equally spaced along said second end, first and second rigid braces coextensively aligned with said first and second ends, respectively, to maintain geometric integrity of the carrier, said first handle means being aligned with said fourth handle means, said second handle means being aligned with said fifth handle means and said third handle means being aligned with said sixth handle means, each of said handle means including an overfolded web to define an inner and outer web member, a plurality of grommets to secure said inner and outer web members together and a continuous flexible cord handle extending outwardly of such overfolded web to define a continuous loop for securement as a handle.

2. The firewood carrier defined in claim 1, in which each handle means further includes a cylindrical tube containing the cord handle therethrough, each cylindrical tube being of a length less than that of a spacing defined between a plurality of grommets of each handle means.

3. The firewood carrier defined in claim 2, in which each rigid brace is a cylindrical member coextensive with the adjacent end of the central web.

4. The firewood carrier defined in claim 3, including a cylindrical tubular container for securement of the firewood carrier when the firewood carrier is in a rolled configuration.

5. In a carrier including an elongated central web and first and second rigid braces secured along the opposite end portions of such web, the improvement comprising a first set of handles extending outwardly of the first brace and a second set of handles extending outwardly of the second brace, each of said sets of handles including a plurality of overfolded web portions defining inner and outer web members and a continuous flexible cord extending outwardly of such overfolded web portions to define a continuous handle loop, the overfolded web portions of said first set of handles being aligned, respectively, with said overfolded web portions of said second set.

* * * * *